United States Patent [19]

Guinle

[11] 4,337,869

[45] Jul. 6, 1982

[54] CLOSURE ASSEMBLY

[75] Inventor: David P. Guinle, Memphis, Tenn.

[73] Assignee: Owens-Illinois, Inc., Toledo, Ohio

[21] Appl. No.: 225,878

[22] Filed: Jan. 19, 1981

[51] Int. Cl.[3] ..... B65D 55/02; H61J 1/00; B65D 85/56

[52] U.S. Cl. ..... 215/201; 215/222; 220/256

[58] Field of Search ..... 215/201, 211, 222; 220/256

[56] References Cited

U.S. PATENT DOCUMENTS 3,974,928 8/1976 Domarack et al. ..... 215/211
4,059,198 11/1977 Mumford ..... 215/222

*Primary Examiner*—George T. Hall

*Attorney, Agent, or Firm*—John R. Nelson; Myron E. Click; David H. Wilson

[57] ABSTRACT

A closure assembly comprises two separable closure members which are pre-assembled in coaxially stacked relationship, with their top panels aligned in the same direction. The lower closure member of the stack assembly comprises locking elements which are engagable with cooperating locking elements on a container, thereby providing a child-resistant closure. The upper closure is a simple snap cap, plug cap, or other closure which is not child-resistant. The upper closure is removably attached to the lower child-resistant closure by an interference fit between resilient attachment members integrally formed as parts of the upper and lower closures. The assembly can be separated, for use of the upper closure only for sealing the container, thereby providing a choice between a child-resistant and non child-resistant closure.

9 Claims, 3 Drawing Figures

CLOSURE ASSEMBLY

BACKGROUND OF THE INVENTION

Containers for many substances, in particular medicines, are required by governmental regulation to be child-resistant. The typical child-resistant closure engages an associated container with releasable locking means, in such a manner that a relatively complex manipulation is required to remove the child-resistant closure from the container. Several types of child-resistant closures are illustrated in U.S. Pat. No. 3,830,391 to Uhlig. In one form of child-resistant closure, the skirt must be squeezed inwardly while the closure is simultaneously rotated, to disengage the locking means. In another form, the closure must be axially pushed downwardly relative to the container while simultaneously being rotated. In still another form, a resilient flange on either the closure skirt or the container neck must be deflected manually from engagement with a locking lug, while the closure is rotated.

While such closures may be effective in preventing access to container contents by children, they are inconvenient to many users. Frequently, adult users, such as those with arthritis, are unable to open child-resistant closures on medicine containers. While it is possible for a customer to request a medicine container having a simple, non child-resistant closure, such a choice leaves the customer without an option to later reseal the container with a child-resistant closure, should he so desire.

U.S. Pat. Nos. 3,865,267 and Re. 29,779 disclose an integral, reversible closure having two closure portions, one with a child-resistant feature and the other without. The reversible closure is oriented on the container such that the desired closure portion seals the container opening.

SUMMARY OF THE INVENTION

The invention provides a stacked closure assembly including two separable closure members, one without a child-resistant feature, and one with a child-resistant feature. In the assembled configuration, only the child-resistant closure is oriented so that it can be applied to an associated container. Specifically, a pharmacist would apply the child-resistant closure member to a medicine vial with the non-resistant closure member connected thereto in a stacked configuration. The customer would later have the option of separating the stacked assembly and resealing the vial with the separated non child-resistant closure. Alternately, the pharmacist could separate the stack assembly and furnish only the closure member desired by the customer.

The lower closure member of the stacked assembly includes child-resistant locking means, which may be of several types known in the art. In the preferred embodiment, the lower closure member is of the "push down and turn" type. This lower child-resistant closure member comprises a circular top panel, and an annular skirt depending from the periphery thereof. A plurality of circumferentially spaced, inwardly projecting keys are integrally formed on the inside surface of the skirt, near the lower annular edge of the skirt.

When the child-resistant closure member is applied, the skirt is disposed around an associated vial rim, and the inwardly projecting keys are adjacent the outside cylindrical surface of the vial. The vial neck includes lugs outwardly projecting from the outside cylindrical surface of the vial having downwardly opening notches constructed and arranged to receive the keys on the closure skirt. The closure member is assembled by aligning the keys with the spaces between the lugs, moving the closure downwardly, and then rotating same clockwise to cam the lugs downwardly and then peripherally to snap into the notches. When the keys are disposed within the notches, the closure cannot be lifted axially straight off the vial, but must first be pushed downwardly and rotated to disengage the keys and notches. Resilient means within the closure biases the closure upwardly from the vial rim, thereby normally retaining the engagement of the keys and notches. Thus a purposeful, complex manipulation including applying forces successively in different directions, is required to unfasten the lower closure member.

The upper closure member of the stacked assembly does not have a child-resistant feature. The upper closure member includes conventional means for engaging the container neck, which may comprise, for example, a snap bead, a plug, or a conventional helical thread. All of these means require only a simple manipulation to remove the closure. In the preferred embodiment, the upper closure member includes a plug sealing member adapted to both engage the vial finish and to engage the upper surfaces of the lower closure member when the assembly is in the stacked configuration.

The preferred upper closure member comprises a top circular panel and an annular skirt depending from the periphery thereof. Depending from the inside surface of the panel is a resilient, integral, annular plug member. The plug member is constructed and arranged to snugly engage the inside cylindrical surface of the vial neck when the upper closure member is used to seal the vial.

The upper closure member is adapted to be stacked on the top panel of the lower, child-resistant closure member, with the lower annular edge of the upper skirt adjacent the top surface of the panel of the lower closure member. The plug member is constructed and arranged to engage by an interference fit the outside of a snap bead projecting upwardly from the top surface of the panel of the lower closure member.

DESCRIPTION OF THE PREFERRED EMBODIMENT

Figure 1:
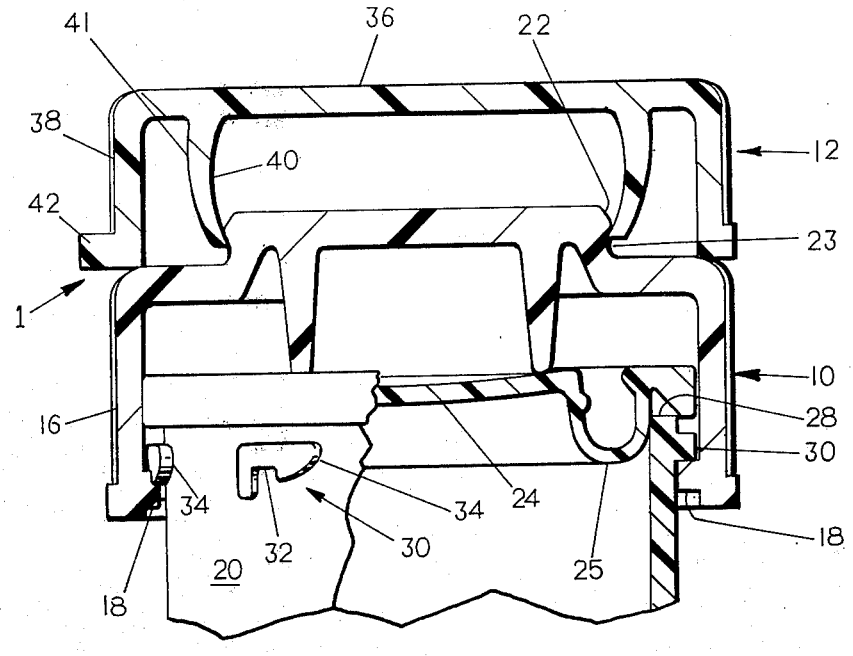
FIG. 1 is an elevational view, partly in section, of a stacked closure assembly embodying the invention, with the lower closure member assembled to an associated vial.

A closure assembly 1 embodying the invention is illustrated in FIG. 1, with the closure members in assembled, stacked relationship on a vial 20. The closure assembly comprises a lower, child-resistant closure 10 and an upper, separable closure 12 which is not child-resistant. In the preferred embodiment, the lower child-resistant closure 10 is a "push and turn" child-resistant closure, and the upper closure 12 is a plug cap. Both closures 10 and 12 are preferably molded from polypropylene, or other thermoplastic material having similar properties.

The lower, child-resistant closure 10 comprises a top circular panel 14 and an annular skirt 16 depending from the periphery thereof. A plurality of integrally formed circumferentially spaced keys 18 project inwardly from the inside cylindrical surface of the skirt 16, near the lower annular edge of the skirt 16. The inside diameter of the skirt 16 is somewhat greater than the outside diameter of associated vial 20, and the inside diameter defined by the inner surfaces of the keys 18 is only slightly greater than the outside diameter of the vial 20.

An integrally formed retention bead 22 projects upwardly from the top surface of the panel 14, to engage the upper plug closure 12, as hereinafter described. As illustrated in FIG. 1, the outer annular side surface of the retention bead 22 is concave in cross-section, thereby forming a conventional snap bead 23.

A disc shaped, elastomeric liner 24 is provided within the child-resistant closure 10. The outside diameter of the liner 24 is greater than the inside diameter defined by the inside surface of the keys 18, hence the liner 24 is retained within the closure 10 by the keys 18.

The liner 24 includes an integral, downwardly projecting, annular plug 25, which is sized to engage the inside cylindrical surface of the vial 20 with a snug interference fit. A narrow, annular portion of the liner 24 surrounds the annular plug 25 and abuts the top of the vial rim 28 when the closure 10 is applied. An annular spacer 26 depends from the inside surface of the panel 14 and abuts the top surface of the liner 24 defined within the diameter of the annular plug 25. When the closure 10 is applied to a vial 20, as hereinafter described, the liner 24 is resiliently deformed between the rim 28 of the vial 20 and the spacer 26, to bias the closure 10 upwardly relative to vial 20.

The vial 20 includes a plurality of circumferentially spaced locking lugs 30 which project outwardly from the outside cylindrical surface of the vial, near the rim 28. The circumferential spacing of the lugs 30 corresponds to the circumferential spacing of the keys 18 on the skirt 16. Each lug 30 includes a downwardly opening notch 32 constructed and arranged to receive a key 18. Each lug also includes slanted camming surfaces 34.

To lock the child-resistant closure 10 in place, the closure 10 is applied to the vial, with the keys 18 circumferentially spaced between the lugs 30. The plug 25 snugly engages the inside cylindrical surface of the vial 20. The resilient liner 24 normally prevents downward movement of the closure 12 sufficient to permit the keys 18 to pass below the lugs 30 and into the notches 32. However, when the closure is rotated, rotation of the keys 18 against the camming surfaces 34 will pull the closure 10 downwardly, deforming the liner 24. Continued rotation will cause the keys 18 to snap into engagement with the notches 32. The upward bias of the deformed resilient liner 24 will then retain the keys 18 in engagement with the notches 32. To remove the child-resistant closure 10, purposeful manipulation is necessary, including simultaneously applied axial force and torque. To disengage the notches 32 and the keys 18, it is first necessary to push downwardly on the closure 10, deforming the resilient liner 24. While the closure is manually held in this axial position relative to the vial 20, the closure 10 is rotated, removing the keys from the notches 32.

Figure 2:
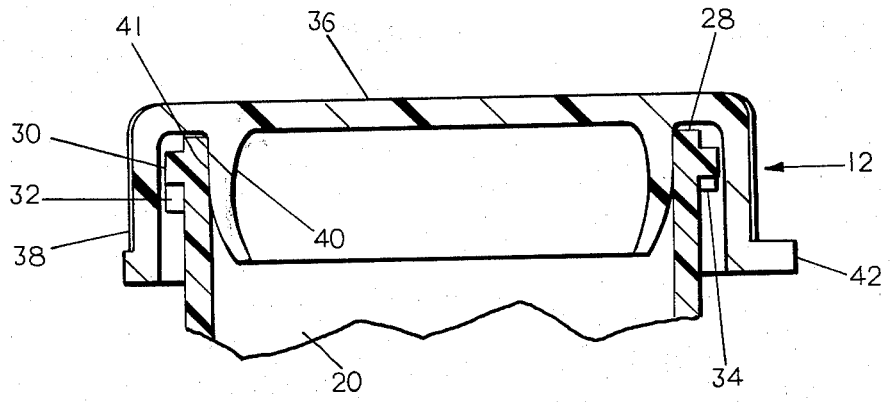
FIG. 2 is a sectional, elevational view, illustrating the upper closure member separated from the lower closure member, and sealingly disposed on an associated vial.

The upper plug closure 12 is illustrated in assembled, stacked relationship to the lower closure 10 in FIG. 1, and alone in sealing relationship to the vial 20 in FIG. 2. The upper closure 12 comprises a top circular panel 36 and an annular skirt 38 depending from the periphery thereof. The skirt 38 has approximately the same diameter as the skirt 16 of the lower, child-resistant closure 10.

An integrally formed annular plug 40 depends from the inside surface of the panel 36. The outside annular surface 41 of the plug 40 is convex, and is sized for an interference fit within the inside cylindrical surface of the vial 20. The lower inside diameter of the plug 40 is slightly less than the outside diameter of the retention bead 22. When the closures 10 and 12 are pre-assembled, the closure 12 is pressed downwardly onto the closure 10, causing the resilient plug 40 to expand slightly around the retention bead 22. In this stacked configuration illustrated in FIG. 1, the closures 10 and 12 are maintained in the stacked assembly by the interference fit between the plug 40 and the retention bead 22.

When desired, the upper closure 12 may be pulled out of engagement with the lower closure 10 and applied along to a vial 20, as illustrated in FIG. 2. As illustrated in FIG. 2, the closure 12 seals the vial 20 by an interference fit between the plug 40 in the inside surface of the vial 20. To facilitate removal of the closure 12 from the closure 10 or from the vial 20, the skirt 38 preferably includes a short lug 42 outwardly projecting from the outside surface of the skirt 38. The lug 42 can be easily pushed by a finger.

The stacked closure assembly 1 described allows a consumer a choice of closures for resealing a container. The releasable attachment of the closures 10 and 12 provided by the resilient plug 40 assures that both closures are readily available.

The closure assembly 1 is stacked such that only the lower, child-resistant closure 10 is exposed for application to a vial 20. In the assembled configuration, the upper plug closure 12 is oriented with the open end of the skirt 38 adjacent to the panel 14 of the lower closure 10, and is hence not available for sealing a container. A consumer who is provided with a medicine vial sealed with the stacked assembly must purposefully separate the closures 10 and 12 in order to reseal the vial in a non child-resistant mode. Hence, careless or casual use of the closure 12, which is not child-resistant, is discouraged.

It should also be noted that the closure assembly 1 may be applied to or removed from the vial 20 without requiring disassembly of upper closure member 12 from lower closure member 10.

Figure 3:
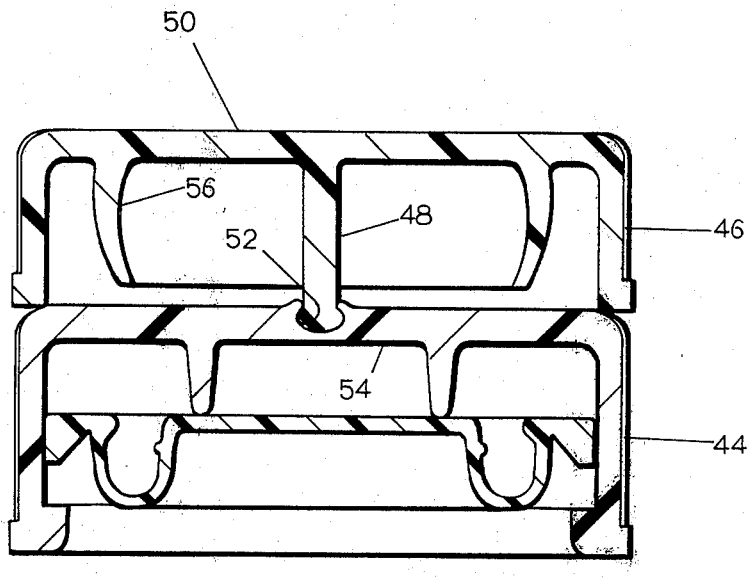
FIG. 3 is a sectional view of an alternate embodiment of the invention, having separate means for retaining the two closure members in stacked relationship.

In the embodiment illustrated in FIGS. 1 and 2, the plug 40 provides means both for sealingly engaging the vial 20 and for retaining the closure 12 on the closure 10. Obviously, other means could be employed to maintain the two closures 10 and 12 in assembled, stacked relationship. An alternative embodiment is illustrated in FIG. 3 including a lower child-resistant closure 44 and an upper closure 46, corresponding generally to the lower closure 10 and the upper closure 12 respectively. However, the upper closure 46 includes a peg 48 downwardly depending from the center of the panel 50 of the upper closure 46. As illustrated in FIG. 3, the peg 48 is engageable by an interference fit with an aperture 52 formed in the panel 54 of the lower child-resistant closure 44. The size and shape of the peg 48 may be designed for a more or less secure attachment between the lower closure 44 and the upper closure 46, as desired. The closure 46 includes an integral annular plug 56 downwardly depending from the panel 50. Like the plug 40 of the closure 12, the plug 56 is sized for a sealing, interference fit within the inside cylindrical surface of an associated vial.

Although a specific form of the child-resistant closure 10 has been illustrated and described, it is obvious that other forms could be employed in a stacked closure assembly. It is necessary only that the lower closure be child-resistant, and include means for retaining an upper closure in stacked assembly. For example, the child-resistant closure could be a threaded closure including detents engageable with a resilient pawl integrally formed as part of the container. In such known child-resistant closures, the resilient pawl must be manually deflected to permit rotational removal of the child-resistant closure.

Likewise, the upper, non child-resistant closure 12 may take other forms. For example, a snap cap engageable with an external annular retention bead on a container rim could be employed. In any case, the upper closure will be removable from the container merely by a simple application of force, such as an upward push, or simple rotation.

Therefore, although specific embodiments have been described in detail, it is understood that variations may be made without departing from the spirit of the invention, and that the scope of the invention is to be limited only by the accompanying claims.

What is claimed is:

1. A closure assembly for a container having an annular neck opening comprising: a first closure member including means for closing said annular neck opening, releasable locking means on said first closure member for engaging cooperating locking means on the container neck, said locking means requiring a complex manipulation for removal of said first closure member from said container; a second closure member, means on said second closure member for closing said container neck opening, said last mentioned means permitting removal of said second closure member from said container neck by a relatively simple manipulation, and cooperating means on said closure members for releasably securing said closure members in stacked relationship.

2. A closure assembly for a container having an annular neck opening comprising: a first closure member including a top circular panel, an annular skirt depending from the periphery of said panel, locking means on said skirt for engaging cooperating locking means on the container neck to secure said first closure member in sealing relationship to the container neck, said locking means requiring a complex manipulation for removal of said first closure member from said container neck; and a second closure member including a top panel, an annular skirt depending from the periphery of said panel, retention means on said second closure member for retaining said second closure member on said container neck in sealing relationship therewith, said retention means requiring a relatively simple manipulation for removal of said second closure member from said container neck, and releasable attachment means on said closures for securing said closure members in stacked relationship.

3. The closure assembly of claim 1 or 2 wherein said second closure member is stackable on top of said first closure member.

4. The closure assembly of claim 2 wherein said second closure member is stackable on said first closure member with the bottom surface of said skirt of said second closure disposed adjacent the top surface of said panel of said first closure member.

5. The closure assembly of claim 1, 2 or 4 wherein said first and second closure members each have a cylindrical outer configuration of substantially equal diameters.

6. The closure assembly defined in claim 2 wherein said first closure member includes an annular retention bead upwardly projecting from the outside surface of said panel of said first closure member, and said second closure includes an annular plug depending from the inside surface of said panel of said second closure member, and sized to engage the periphery of said retention bead with an interference fit, for securing said second closure member in stacked relationship on said first closure member.

7. The closure assembly defined in claim 6 wherein said plug of said second closure member has an outside diameter slightly larger than the inside diameter of an associated vial, whereby said plug is sealingly engagable with the inside surface of said vial by an interference fit.

8. The closure assembly defined in claim 2 wherein said panel of said first closure member includes an aperture formed therein, and said means for releasably securing said closure members comprises a peg downwardly projecting from the inside surface of said panel of said second closure member and constructed and arranged to fit snugly within said aperture when said closures are assembled in stacked relationship.

9. The closure assembly defined in claim 2 wherein said closure members are stacked with said first closure member lowermost and said second closure member disposed adjacent the top surface of said panel of said second closure member, the said panels of said closure members being oriented in the same axial direction, whereby only said first closure member can be sealingly applied to a container neck when said closure members are in stacked, assembled relationship.

* * * * *